US009903659B2

(12) United States Patent
Christians et al.

(10) Patent No.: US 9,903,659 B2
(45) Date of Patent: Feb. 27, 2018

(54) LOW PRESSURE CHILLER

(71) Applicant: Carrier Corporation, Farmington, CT (US)

(72) Inventors: Marcel Christians, Skaneateles, NY (US); Jack Leon Esformes, Jamesville, NY (US); Satyam Bendapudi, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 196 days.

(21) Appl. No.: 14/651,856

(22) PCT Filed: Oct. 9, 2013

(86) PCT No.: PCT/US2013/064074

§ 371 (c)(1),
(2) Date: Jun. 12, 2015

(87) PCT Pub. No.: WO2014/092850

PCT Pub. Date: Jun. 19, 2014

(65) Prior Publication Data

US 2015/0316325 A1 Nov. 5, 2015

Related U.S. Application Data

(60) Provisional application No. 61/736,747, filed on Dec. 13, 2012.

(51) Int. Cl.
*A23C 3/04* (2006.01)
*F28D 3/02* (2006.01)
(Continued)

(52) U.S. Cl.
CPC ..... *F28D 3/02* (2013.01); *F24F 5/001* (2013.01); *F24F 11/06* (2013.01); *F25B 39/02* (2013.01);
(Continued)

(58) Field of Classification Search
CPC ... F28D 3/02; F24F 5/001; F24F 11/06; F25B 39/02; F25B 2400/13; F25B 2400/23
(Continued)

(56) References Cited

U.S. PATENT DOCUMENTS 3,412,569 A 11/1968 Arledge, Jr.
6,167,713 B1 * 1/2001 Hartfield ..... F25B 39/028 165/160
2015/0316325 A1 11/2015 Christians et al.

FOREIGN PATENT DOCUMENTS

CN 200996753 Y 12/2007
CN 201858811 U 6/2011
(Continued)

OTHER PUBLICATIONS

International Preliminary Report on Patentability; Application No. PCT/US2013/064074; dated Jun. 16, 2015; 6 pages.
(Continued)

*Primary Examiner* — Davis Hwu
(74) *Attorney, Agent, or Firm* — Cantor Colburn LLP

(57) ABSTRACT

A heating, ventilation and air conditioning (HVAC) system includes a condenser to condense a flow of refrigerant into a liquid state. The system further includes an economizer assembly having at least one separator chamber to separate liquid refrigerant from vapor refrigerant. The economizer assembly shares an upper common wall with at least a portion of the condenser and the flow of refrigerant from the condenser into the economizer assembly proceeds through a flow opening in the upper common wall. A falling film evaporator exchanges thermal energy between the liquid refrigerant and a medium flowed through a plurality of evaporator tubes in the evaporator.

19 Claims, 3 Drawing Sheets

(51) Int. Cl.
*F25B 39/02* (2006.01)
*F24F 5/00* (2006.01)
*F24F 11/06* (2006.01)

(52) U.S. Cl.
CPC ... *F25B 2339/0242* (2013.01); *F25B 2400/13* (2013.01); *F25B 2400/23* (2013.01); *F25B 2500/01* (2013.01)

(58) Field of Classification Search
USPC ..... 165/117
See application file for complete search history.

(56) References Cited

FOREIGN PATENT DOCUMENTS

| | | | |
|---|---|---|---|
| CN | 201954825 | U | 8/2011 |
| EP | 0921364 | A2 | 6/1999 |
| GB | 2003263 | A | 3/1979 |
| JP | S5758051 | A | 4/1982 |
| WO | 200144730 | A1 | 6/2001 |
| WO | 2009086493 | A2 | 7/2009 |

OTHER PUBLICATIONS

International Preliminary Report, PCT US2013/064074, dated Jun. 16, 2015, 6 pages.
Notification of Transmittal of the International Search Report of the International Searching Authority, or the Declaration; PCT/US2013/064074; dated Feb. 5, 2014; 5 Pages.
Written Opinion of the International Searching Authority; PCT/US2013/064074; dated Feb. 5, 2014; 5 Pages.
Chinese Office Action dated Apr. 26, 2017; Chinese Application No. 201380065093, Filed Oct. 9, 2013 (translation).

* cited by examiner

LOW PRESSURE CHILLER

BACKGROUND

The subject matter disclosed herein relates to heating, ventilation and air conditioning (HVAC) systems. More specifically, the subject matter disclosed herein relates to chillers.

As regulatory & industry trends continue to drive towards replacement of conventional HFC's like R134a of particular interest are the class of "low pressure refrigerants", i.e. refrigerants that are near, or below atmospheric pressure at the boiling temperatures in a chiller. These have long been known to provide better thermodynamic cycle performance over medium (R134a) or higher (R410A) pressure refrigerants, due to their higher latent heats of vaporization and other thermodynamic properties. However, yet other thermodynamic properties such as vapor density or transport properties such as surface tension can reduce heat transfer performance and offset a significant portion of the thermodynamic cycle performance gains. Further, low pressure refrigerants have significantly greater specific volumes, resulting in the need for larger vapor spaces and pipes to connect the components of the chiller system. The larger vapor spaces and pipes are more costly and increase the volumetric footprint required to accommodate the chiller system.

BRIEF SUMMARY

In one embodiment, a heating, ventilation and air conditioning (HVAC) system includes a condenser to condense a flow of refrigerant into a liquid state. The system further includes an economizer assembly having at least one separator chamber to separate liquid refrigerant from vapor refrigerant. The economizer assembly shares an upper common wall with at least a portion of the condenser and the flow of refrigerant from the condenser into the economizer assembly proceeds through a flow opening in the upper common wall. A falling film evaporator exchanges thermal energy between the liquid refrigerant and a medium flowed through a plurality of evaporator tubes in the evaporator.

In another embodiment, a method of operating a heating, ventilation and air conditioning (HVAC) system includes condensing a flow of refrigerant into a liquid state in a condenser and flowing the flow of refrigerant from the condenser to an economizer assembly via a flow opening in an upper common wall shared by the condenser and at least a portion of the economizer assembly. Liquid refrigerant is separated from vapor refrigerant in the flow of refrigerant at at least one separator chamber of the economizer assembly. The liquid refrigerant is flowed into a falling film evaporator to exchange thermal energy between the liquid refrigerant and a medium flowed through a plurality of evaporator tubes in the evaporator.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
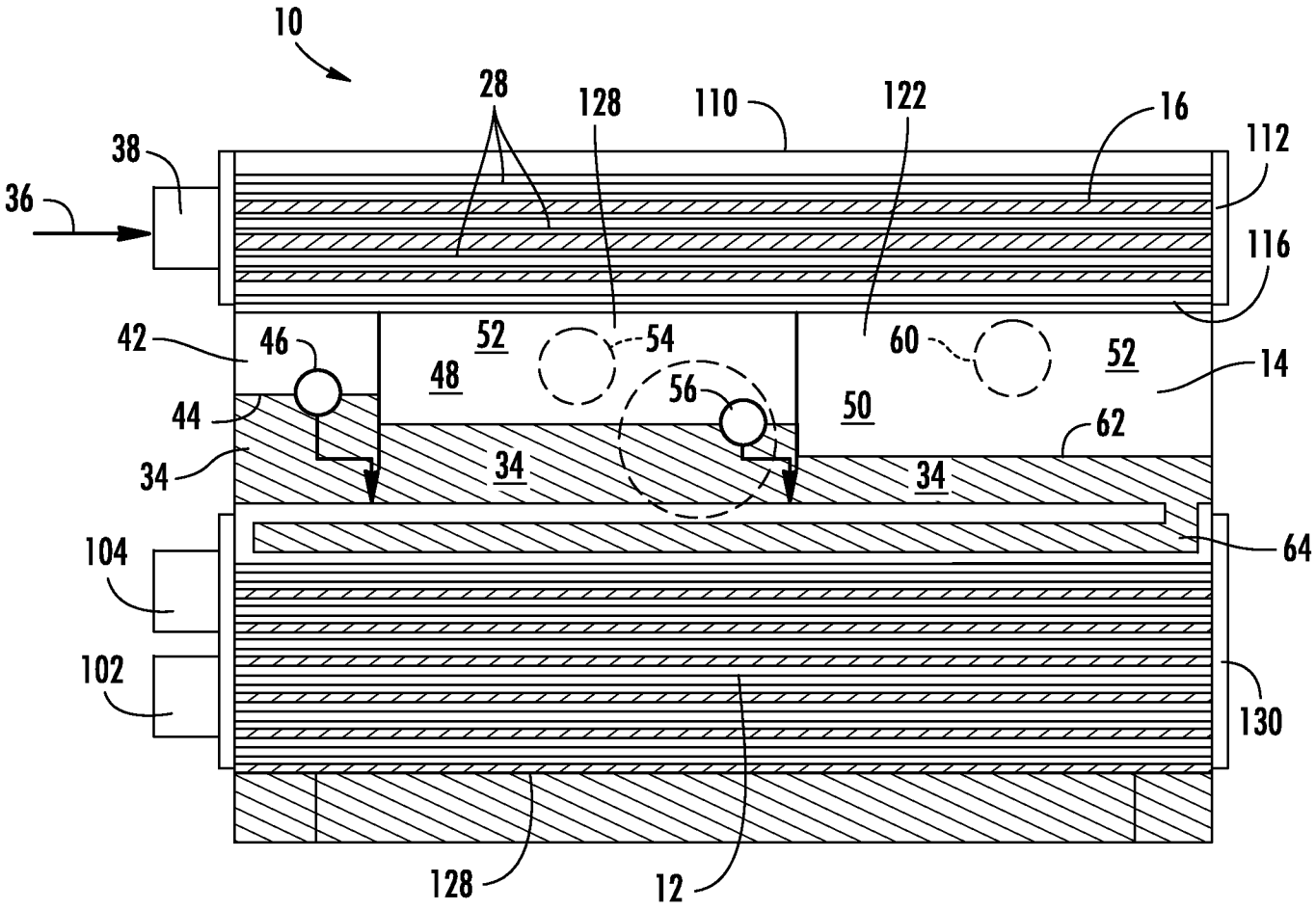
FIG. 1 is an elevation view of an embodiment of a chiller.

The detailed description explains embodiments of the invention, together with advantages and features, by way of example with reference to the drawing.

DETAILED DESCRIPTION

Embodiments of low pressure refrigerant chiller systems are disclosed herein. Initially, it should be understood that the term "low pressure refrigerant" defines refrigerant having a liquid phase saturation pressure below about 45 psi (310.3 kPa) at 104° F. (40° C.). An example of low pressure refrigerant includes R245fa. It should also be understood that while described as employing a low pressure refrigerant, the exemplary embodiments could also employ a medium pressure refrigerant. The term "medium pressure refrigerant" defines a refrigerant having a liquid phase saturation pressure between 45 psia (310.3 kPa) and 170 psia (1172 kPa) at 104° F. (40° C.).

Specifically, embodiments of low pressure refrigerant chiller systems are disclosed which are configured to better take advantage of thermodynamic cycle performance advantages over medium or high pressure refrigerant chiller systems, by reducing the impact of heat transfer disadvantages noted regarding low pressure refrigerants. These improvements include the use of a falling film evaporator in low pressure systems, which ensures that the boiling temperature is substantially uniform in the falling film tube bundle, since the tube bundle is not submerged in a refrigerant pool. Such submersion results in higher boiling temperatures in the submerged portions and the reduction in heat transfer performance. Additionally, the use of a falling film evaporator facilitates the efficient removal of the large refrigerant vapor flow from the tubes, ensuring continuous liquid feed, and thus increasing heat transfer performance. Low pressure systems allow use of cost effective rectangular components. As such, the aspect ratio of the condenser can be optimized to correct the heat transfer deficiency in the condenser by virtue of the poorer thermodynamic and transport properties of lower pressure refrigerants. In addition, the aspect ratio of the evaporator can be optimized to maximize heat transfer performance in the falling film tube bundle by ensuring more complete wetting of the tubes.

Further, the disclosed embodiments reduce the footprint necessary to accommodate the chiller system by nesting rectangular components, eliminating piping connections between components and providing flow therethrough via openings in shared walls of the components.

Figure 2:
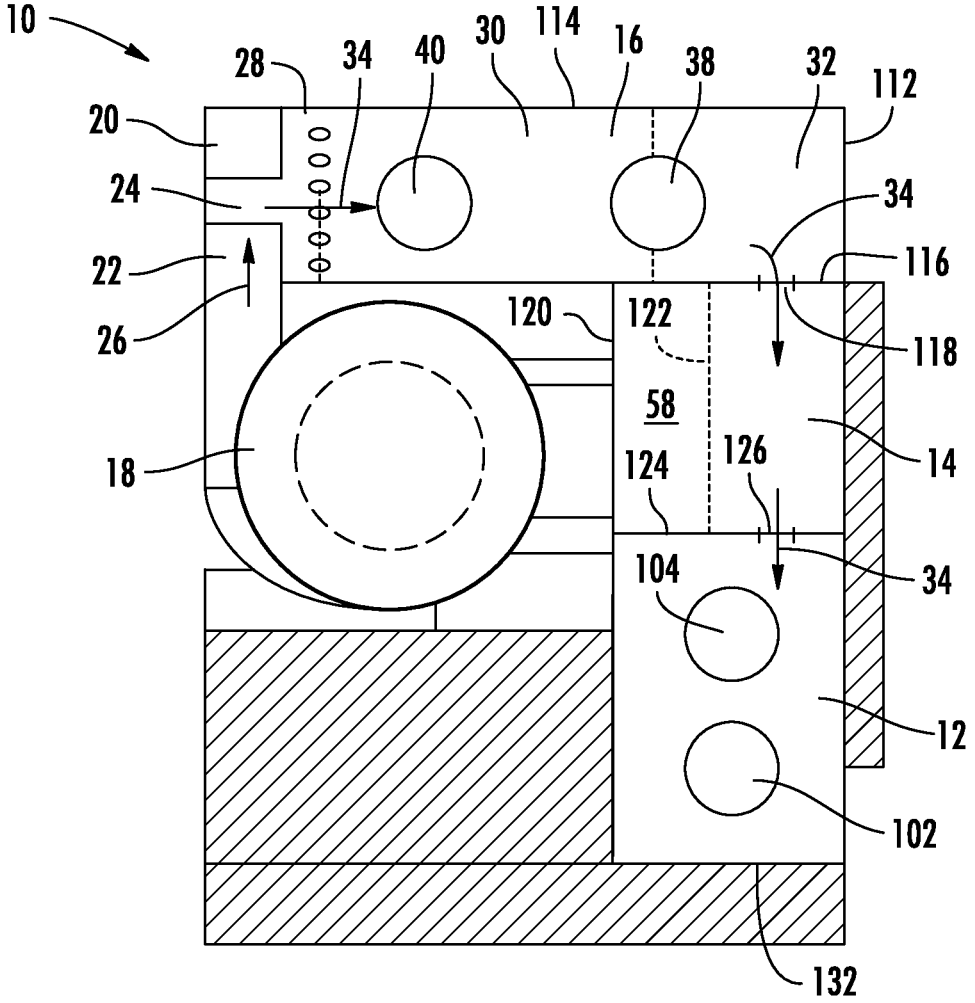
FIG. 2 is an end view of an embodiment of a chiller.

Shown in FIG. 1 is an embodiment of a heating, ventilation and air conditioning (HVAC) unit, for example, a chiller 10 utilizing a low pressure refrigerant and a falling film evaporator 12. The chiller 10 is gravity fed, with the evaporator 12 beneath an economizer assembly 14 and a condenser 16. The chiller 10 also includes a compressor 18, as shown in FIG. 2. The compressor 18 of the embodiment shown is a two-stage compressor 18 that discharges upwardly into a corner 20 of the condenser 16. A discharge area 22 of the compressor 18 is separated from the condenser 16 by a baffle plate 24 to prevent impingement of high velocity vapor condenser output 26 on condenser tubes 28 and prevent tube 28 vibration issues.

The condenser 16 is separated into a main condenser 30 and a flasc subcooler 32. Use of the subcooler 32 in the condenser 16 ensures that all of the refrigerant 34 flowing through the chiller 10 reaches the evaporator 12 in a liquid state. Referring again to FIG. 1, the condenser 16 is a vertically short and horizontally long vessel, and is substantially cuboid, having six rectangular faces. It is to be appreciated that, throughout this application, the term "rectangular" is used to denote rectangular shapes having either sharp corners or rounded corners. As shown, condenser length 110 is defined along a length of condenser tubes 28, while condenser height 112 is vertically up-down in FIG. 1 and FIG. 2, and condenser width 114 is horizontal in the side view of FIG. 2. In some embodiments, the aspect ratio of condenser width 114 to condenser height 112 is greater than 1 and less than about 3. The condenser tubes 28 have a flow of liquid 36, for example, water, flowed therethrough between a condenser water inlet nozzle 38 and a condenser water outlet nozzle 40. The refrigerant 34 output from the compressor 18 as vapor is condensed to liquid by the liquid 36 flowing through the condenser tubes 28.

From the condenser 16, the refrigerant 34 is fed into the economizer assembly 14. The economizer assembly 14 of the embodiment of FIG. 1 includes three chambers, but it is to be appreciated that other quantities of chambers may be utilized. In some embodiments, the economizer assembly is substantially cuboid, with six rectangular faces. Further, in some embodiments, the condenser 16 and economizer assembly 14 are arranged to share at least a portion of an upper common wall 116 between the condenser 16 and the economizer assembly 14, with the two components substantially abutting one another. This allows for flow between the condenser 16 and the economizer assembly 14 via a flow opening 118 in the upper common wall 116 without additional external tubing or piping.

The refrigerant 34 initially flows into a high-side chamber 42 of the economizer assembly 14 in which a high side refrigerant level 44 is controlled via a high-side float 46 or other metering device that allows refrigerant 34 flow through from the high side chamber 42 to an economizer chamber 48. From the high side chamber 42, the refrigerant 34 flows into the economizer chamber 48 and is flashed therein resulting in a volume of refrigerant vapor 52 and a volume of chilled refrigerant 34. The flow of refrigerant 34 between the high side chamber 42 and the economizer chamber 48 is driven by a pressure differential between the two chambers 42 and 48. The resulting refrigerant vapor 52 is introduced into the compressor 18 in, for example, a second stage of the compressor 18 (shown in FIG. 2) through an economizer nozzle 54 located in a common economizer wall 120 between the economizer assembly 14 and the compressor 18. The liquid refrigerant 34 settles in the economizer chamber 48 and proceeds into a separator chamber 50 by operation of a low side float 56, or other metering device that controls flow between the economizer chamber 48 and the separator chamber 50. Vapor refrigerant 52 in the separator chamber 50 is routed to a suction plenum 58 (shown in FIG. 2) located adjacent to and sharing a suction plenum wall 122 with the economizer assembly 14, via a separator chamber port 60. Locating the suction plenum 58 and the economizer assembly 14 with a shared wall allows the separator chamber port 60 to be merely a hole in the wall, thus eliminating piping and fittings that are typically used in such a connection between a suction plenum and separator. The liquid refrigerant 34 in the separator chamber 50 reaches a separator chamber level 62 and is allowed to flow into the evaporator 12 via gravity. The evaporator 12 is configured as a cuboid structure with six substantially rectangular faces, and is located below the economizer assembly 14. In some embodiments, the evaporator 12 abuts the economizer assembly 14 at a lower common wall 124 separating the two components, with an evaporator opening 126 in the lower common wall 124 allowing for flow from the economizer assembly 14 into the evaporator 12. The evaporator 12 has an evaporator length 128 extending substantially parallel to the condenser length 110 as shown in FIG. 1, and an evaporator height 130 extending up-down as shown in FIG. 1. Further, the evaporator 12 has an evaporator width 132 extending left-right in the cross-sectional view of FIG. 2. In some embodiments, the evaporator 12 has an aspect ratio of evaporator height 130 to evaporator width 132 of greater than 1 and less than about 3.

In some embodiments, separator chamber port 60 is adjustable to increase or decrease pressure in third chamber 50. For example, when separator chamber port 60 is opened, pressure in separator chamber 50 decreases, thereby increasing the refrigerant 34 urged from the second chamber 48 to the separator chamber 50, raising the separator chamber level 62. As the separator chamber level 62 rises, separator chamber port 60 may be constricted to increase the pressure in separator chamber 50 to drive an increased amount of liquid refrigerant 34 from the separator chamber 50 into an evaporator manifold 64. Such increased flow of liquid refrigerant 34 is desired under certain operating conditions, for example, high load conditions.

Figure 3:
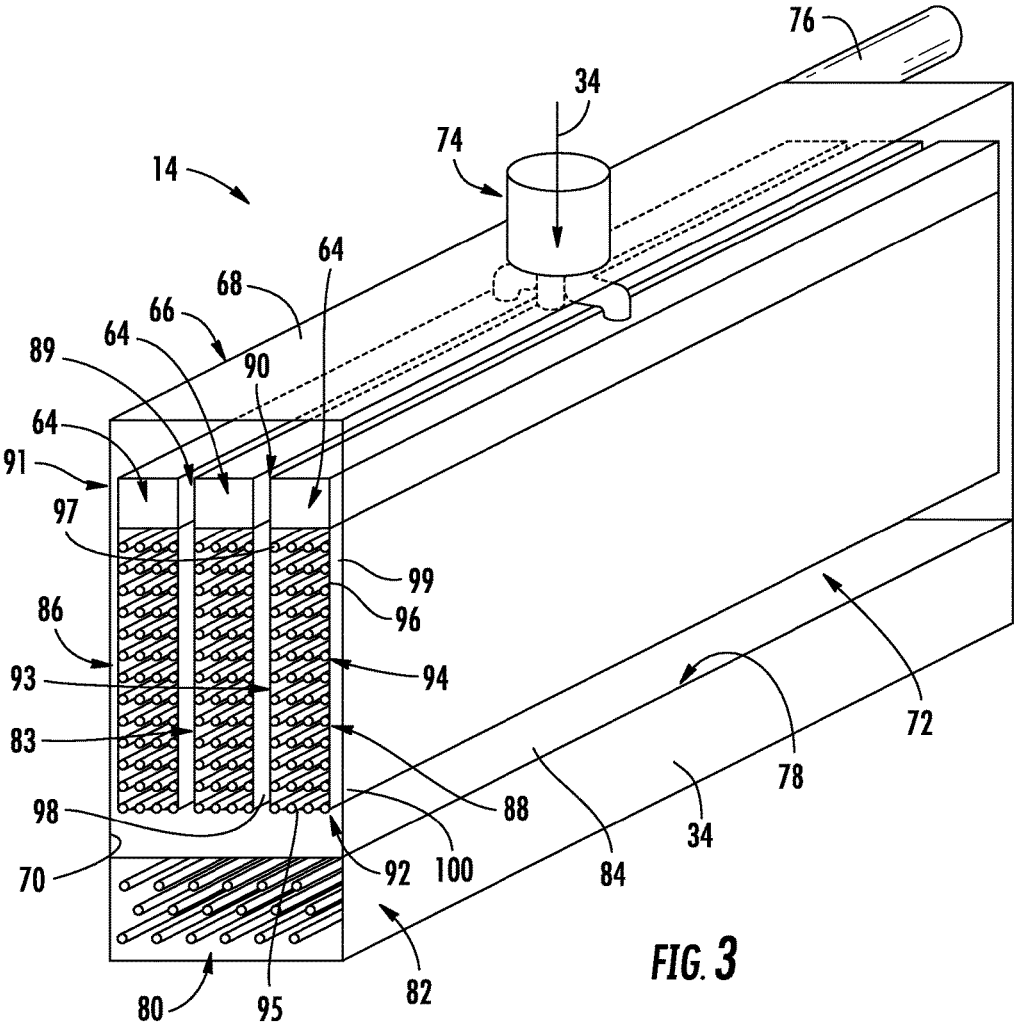
FIG. 3 is a schematic view of an embodiment of an evaporator for a chiller.

Referring now to FIG. 3, the evaporator 12 includes a shell 66 having an outer surface 68 and an inner surface 70 that define a heat exchange zone 72. In the exemplary embodiment shown, shell 66 includes a non-circular cross-section. For example, shell 66 may have a rectangular cross-section with a horizontal width (as shown in FIG. 2) less than a vertical height. Shell 66 includes a refrigerant inlet 74 from the evaporator manifold 64 to receive the liquid refrigerant 34. Shell 66 also includes a vapor outlet 76 that is connected to the compressor 18. Evaporator 12 is also shown to include a low pressure refrigerant pool zone 78 arranged in a lower portion of shell 66. Low pressure refrigerant pool zone 78 includes a pool tube bundle 80 that circulates a fluid through a pool of low pressure refrigerant 82. Pool of low pressure refrigerant 82 includes an amount of liquid low pressure refrigerant 34 having an upper surface 84. The fluid circulating through the pool tube bundle 80 exchanges heat with pool of low pressure refrigerant 82 to convert the amount of low pressure refrigerant 82 from a liquid to a vapor state.

In accordance with the exemplary embodiment shown, evaporator 12 includes a plurality of tube bundles 86-88 that provide a heat exchange interface between low pressure refrigerant and another fluid. At this point it should be understood that while shown with a plurality of tube bundles 86-88, a single tube bundle could also be employed in connection with economizer assembly 14. Each tube bundle 86-88 is connected to evaporator manifold 64. Evaporator manifold 64 provides a uniform distribution of refrigerant onto tube bundles 86-88. As will become more fully evident below, evaporator manifold 64 delivers low pressure refrigerant 34 onto tube bundles 86-88. Tube bundles 86-88 are spaced one from another to form first and second vapor passages 89 and 90. In addition, tube bundles 86 and 88 are spaced from inner surface 70 to establish first and second outer vapor passages 91 and 92. As each tube bundle 86-88 is substantially similarly formed, a detailed description will follow with reference to tube bundle 88 and evaporator manifold 64 with an understanding the tube bundles 86 and 87 are similarly constructed.

In further accordance with the exemplary embodiment shown, tube bundle 88 includes first and second wall members 93 and 94. First and second wall members 93 and 94 are spaced one from another to define a tube channel 95 through which pass a plurality of tubes 96 that are configured to carry a liquid. As will become more fully evident below, liquid passing through the plurality of tubes 96 is in a heat exchange relationship with the low pressure refrigerant flowing into tube channel 95. First wall member 93 includes a first end 97 and extends to a second end 98. Similarly, second wall member 94 includes a first end 99 and extends to a second end 100. Each first end 97 and 99 is spaced below evaporator manifold 64 while each second end 98 and 100 is spaced above low pressure refrigerant pool 34. With this arrangement, liquid low pressure refrigerant flowing from evaporator manifold 64 flows, under force of gravity, through tube channel 95, over tubes 96 and passes into low pressure refrigerant pool 34. In this manner, the refrigerant reduces a temperature of liquid, for example, water, flowing through tubes 96 before transitioning to a vapor for return to, the compressor 16 via the vapor outlet 76. Liquid flows through tubes 96 via evaporator liquid inlet 102 and evaporator liquid outlet 104.

At this point it should be understood that the example embodiments describe a shell and tube evaporator that employs a low pressure refrigerant to facilitate heat exchange with a secondary medium. The use of falling film systems and low pressure refrigerant provides various advantages over prior art systems. For example, the use of falling film systems employing low pressure refrigerant reduces pressure losses associated with flow through the tube bundles as compared to conventional flooded evaporator bundles of similar size. In addition, falling film systems employ a lower refrigerant charge, thereby leading to an overall cost reduction. Additional benefits are realized by higher heat transfer coefficients associated with using falling film evaporation in a low pressure refrigerant. It should be also understood, that while shown as having a circular cross-section, the tubes in the tube bundles can be formed from tubes having non-circular cross-sections and/or tubes formed of assemblies of brazed channels.

Further, the arrangement described herein utilizes gravity to drive flow from the economizer assembly 14 into the evaporator manifold 64. Configuring the condenser as vertically short increases condenser efficiency, in some embodiments by about 30% over traditionally configured condensers as well as allows for a compact arrangement of system components. Further, the compressor and evaporator/separator structures are load bearing thus reducing structural support requirements for the system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heating, ventilation and air conditioning (HVAC) system comprising:

a condenser to condense a flow of refrigerant into a liquid state;

an economizer assembly including at least one separator chamber to separate liquid refrigerant from vapor refrigerant, the economizer assembly sharing an upper common wall with at least a portion of the condenser and the flow of refrigerant from the condenser into the economizer assembly proceeding through a flow opening in the upper common wall; and a falling film evaporator to exchange thermal energy between the liquid refrigerant and a medium flowed through a plurality of evaporator tubes in the evaporator;

wherein the condenser, the economizer and the falling film evaporator are arranged vertically such that an economizer exit port is disposed vertically above the plurality of evaporator tubes, for gravity-driven flow of liquid refrigerant from the economizer to the evaporator.

2. The HVAC system of claim 1, wherein the upper shared wall is an upper wall of the economizer assembly and a lower wall of the condenser.

3. The HVAC system of claim 1, wherein the economizer assembly shares a lower common wall with at least a portion of the evaporator.

4. The HVAC system of claim 3, wherein the flow of liquid refrigerant from the economizer assembly into the evaporator is through an evaporator opening in the lower common wall.

5. THE HVAC system of claim 3, wherein the lower common wall is a lower wall of the economizer assembly and an upper wall of the evaporator.

6. The HVAC system of claim 1, wherein the condenser has a width greater than its height.

7. The HVAC system of claim 6, wherein a ratio of condenser width to condenser height is between 1 and about 3.

8. The HVAC system of claim 1, wherein the evaporator has a height greater than its width.

9. The HVAC system of claim 6, wherein a ratio of evaporator height to evaporator width is between 1 and about 3.

10. The HVAC system of claim 1, wherein at least one of the condenser, the economizer assembly and the evaporator are cuboid in shape.

11. The HVAC system of claim 1, wherein the flow of refrigerant comprises an amount of low pressure refrigerant having a liquid phase saturation pressure below about 45 psi (310.3 kPa) at 104° F. (40° C.).

12. The HVAC system of claim 1, further comprising a compressor to urge the flow of refrigerant into the condenser.

13. The HVAC system of claim 12, wherein the compressor discharges substantially upwardly into the condenser.

14. The HVAC system of claim 1, wherein a separator chamber of the economizer assembly includes an adjustable separator port to increase and/or decrease pressure in the separator chamber.

15. The HVAC system of claim 14, wherein the separator port is an opening in a common wall between the separator chamber and a suction plenum.

16. A method of operating a heating, ventilation and air conditioning (HVAC) system comprising:

condensing a flow of refrigerant into a liquid state in a condenser;

flowing the flow of refrigerant from the condenser to an economizer assembly via a flow opening in an upper common wall shared by the condenser and at least a portion of the economizer assembly;

separating liquid refrigerant from vapor refrigerant in the flow of refrigerant at at least one separator chamber of the economizer assembly; and flowing the liquid refrigerant into a falling film evaporator to exchange thermal energy between the liquid refrigerant and a medium flowed through a plurality of evaporator tubes in the evaporator;

wherein the condenser, the economizer and the falling film evaporator are arranged vertically such that an economizer exit port is disposed vertically above the plurality of evaporator tubes, for gravity-driven flow of the liquid refrigerant from the economizer to the evaporator.

17. The method of claim 16, wherein a direction of the flow of refrigerant from the condenser into the economizer assembly is substantially downward.

18. The method of claim 16, further comprising flowing the liquid refrigerant into the falling film evaporator from the economizer assembly via an evaporator opening in a lower common wall shared by the economizer assembly and at least a portion of the evaporator.

19. The method of claim 18, wherein a direction of the flow of liquid refrigerant from the economizer assembly into the evaporator is substantially downward.

* * * * *